US010899515B2

(12) United States Patent
Maguire et al.

(10) Patent No.: US 10,899,515 B2
(45) Date of Patent: Jan. 26, 2021

(54) CONTAINER CLOSURE HAVING MEANS FOR INTRODUCING AN ADDITIVE INTO A LIQUID IN THE CONTAINER

(71) Applicant: Gizmo Packaging Limited, Glasgow (GB)

(72) Inventors: Jordan Maguire, Glasgow (GB); Bernard Frutin, Glasgow (GB)

(73) Assignee: GIZMO PACKAGING LIMITED, Glasgow (GB)

( * ) Notice: Subject to any disclaimer, the term of this patent is extended or adjusted under 35 U.S.C. 154(b) by 154 days.

(21) Appl. No.: 16/305,187

(22) PCT Filed: May 24, 2017

(86) PCT No.: PCT/GB2017/051460

§ 371 (c)(1),
(2) Date: Nov. 28, 2018

(87) PCT Pub. No.: WO2017/207962

PCT Pub. Date: Dec. 7, 2017

(65) Prior Publication Data

US 2020/0247597 A1 Aug. 6, 2020

(30) Foreign Application Priority Data

Jun. 2, 2016 (GB) ..... 1609670.3
Oct. 26, 2016 (GB) ..... 1618071.3

(51) Int. Cl.
*B65D 51/28* (2006.01)
*B65D 43/02* (2006.01)

(52) U.S. Cl.
CPC ..... *B65D 51/2864* (2013.01); *B65D 43/0231* (2013.01)

(58) Field of Classification Search
CPC .... B65D 43/02; B65D 43/0231; B65D 51/28; B65D 51/2864; B65D 51/2892
(Continued)

(56) References Cited

U.S. PATENT DOCUMENTS 7,886,899 B2 * 2/2011 Frutin ..... B65D 51/2892 206/221
9,045,269 B2 * 6/2015 Frutin ..... B65D 51/2864
(Continued)

FOREIGN PATENT DOCUMENTS

CN 101479165 A 7/2009
DE 102014113391 A1 11/2015
(Continued)

OTHER PUBLICATIONS

Serrano Galarraga, J., "International Search Report," prepared for PCT/GB2017/051460, dated Jul. 17, 2017, three pages.

*Primary Examiner* — Bryon P Gehman
(74) *Attorney, Agent, or Firm* — Edell, Shapiro & Finnan, LLC

(57) ABSTRACT

A closure device (210) for dispensing an additive product into a container (34) having a main liquid compartment and an opening with a threaded container neck (38) comprises a cap member (36) having a threaded side wall (37) adapted to be secured to the threaded container neck (38), a pressurised fluid chamber (60) fixed to the cap member (36) containing an additive product, and a plug member housing (54) including a plug member (64) engageable in a bottom aperture (66) of the fluid chamber and a flange portion (58) adapted to extend across the top of the container neck (38). The plug member housing (54) can move relative to the cap member (36) between a first closed or armed position of the closure device, in which the plug member (64) seals the bottom aperture (66) closed, and in which a first detent member (58A) provided on the plug member housing is
(Continued)

engaged by a second detent member (80) provided on the cap member to prevent movement of the plug member housing (54) away from the cap member (36), and a second open or firing position, in which the plug member housing (54) is urged towards the cap member (36) by contact with the threaded container neck (38) and the plug member (64) is raised relative to the bottom aperture (66) to provide a fluid path from the fluid chamber (60) through a nozzle (74) to the main liquid compartment of the container (34), so that the closure device (210) is moved to the firing position by screwing down onto the neck (38).

18 Claims, 4 Drawing Sheets

(58) Field of Classification Search
USPC ..... 206/219, 221
See application file for complete search history.

(56) References Cited

U.S. PATENT DOCUMENTS

| | | | | |
|---|---|---|---|---|
| 9,902,538 | B2 * | 2/2018 | Presche | B65D 51/2892 |
| 10,472,142 | B2 * | 11/2019 | Presche | B65D 51/2864 |
| 2009/0321286 | A1 * | 12/2009 | Frutin | B65D 51/2892<br>206/219 |

FOREIGN PATENT DOCUMENTS

| | | | |
|---|---|---|---|
| JP | 2005193925 | A | 7/2005 |
| WO | WO-2007129116 | A1 | 11/2007 |
| WO | WO-2015169824 | A1 | 11/2015 |
| WO | WO-2016128420 | A2 | 8/2016 |
| WO | WO-2017199024 | A1 | 11/2017 |

* cited by examiner

CONTAINER CLOSURE HAVING MEANS FOR INTRODUCING AN ADDITIVE INTO A LIQUID IN THE CONTAINER

The present invention relates to a closure device, for use with a container such as a beverage container, which can fire a pressurised additive liquid into a liquid in the container by operation of the closure device. The invention also relates to a container including such a closure device and to a method of introducing an additive liquid by means of operating such a closure device.

In a number of applications, such as mixtures of different liquids, it may be necessary to release and mix an additive liquid into another liquid shortly before the liquid mixture is used. It may not be possible or desirable to store the liquids in a premixed form, as they may react undesirably with each other when stored as the mixture for a period of time. An example of this may be two component pharmaceuticals which have a longer shelf life when unmixed than they do when mixed. However, it can also apply to other liquids or to mixtures of liquids and gases, such as water, alcoholic beverages, other beverages, and other solvents or solutions. The term "beverage" when used in this specification includes any liquid, whether or not provided for drinking purposes, which may be mixed with an additive liquid, and is not limited to potable beverages.

A closure device for use with a beverage container which can release an additive liquid into the beverage by operation of the closure device is known from the prior art. International Patent Application WO2007/129116 discloses a closure device comprising a cap member defining a fluid chamber and a plug member which sealingly engages an aperture in the bottom of the fluid chamber. The cap member is raised relative to the plug member by unscrewing the cap member, from a closed position in which the plug member closes the bottom aperture to an open position in which the plug member is partially withdrawn from the bottom aperture to allow pressurised fluid to flow from the fluid chamber through a nozzle passage in the plug member to the beverage in the beverage container.

The known device has the disadvantage that it is relatively complex to manufacture, requiring separate housing and cap members, both of which extend outside the neck of the container. The closure has a larger diameter than conventional closures, since it must accommodate a housing flange between the external thread of the bottle neck and the internal thread of the outer cap wall. The closure requires the threaded connection between the cap and the housing flange to turn first, so that the cap member is raised relative to the plug member causing the additive to be fired from the pressurised fluid chamber, before the threaded connection between the housing flange and the bottle neck. If the threaded connection between the cap and the housing flange is too stiff, the threaded connection between the housing flange and the bottle neck may turn first, so that the closure device is removed from the bottle without firing.

It is an object of the present invention to overcome one or more disadvantages of the prior art.

Closure Device

According to a first aspect of the present invention there is provided a closure device for dispensing an additive product into a container having a main liquid compartment and an opening with a threaded container neck, the closure device comprising:

a cap member having a threaded side wall adapted to be secured to the threaded container neck, a fluid chamber fixed to the cap member and having a bottom aperture at its lower end, a plug member housing including a plug member and a flange portion adapted to extend at least partially across the top of the container neck, the plug member being sealingly engageable in the bottom aperture of the fluid chamber, wherein the plug member housing is adapted to move relative to the cap member between a first closed position of the closure device, in which the plug member seals the bottom aperture closed and in which a first detent member provided on the plug member housing is engaged by a second detent member provided on the cap member to prevent movement of the plug member housing away from the cap member, and a second open or firing position, in which the plug member housing is urged towards the cap member by contact with the threaded container neck and the plug member is raised relative to the bottom aperture to provide a fluid path for the additive product from the fluid chamber through or around the plug member to the main liquid compartment.

The plug member housing is adapted to be raised relative to the bottom aperture and cap member by urging the cap member down relative to the neck by screwing action to overcome the resistance provided by the pressurised fluid chamber acting on the plug member while the plug member housing remains in contact with the neck. The screwing action may use the threaded side wall of the cap member and the threaded container neck.

Preferably the fluid chamber is pressurised.

Preferably the fluid chamber contains a pressurised additive liquid and a propellant fluid.

The plug member may include a nozzle at its lower end. The fluid path for the additive product in the open position may extend from the fluid chamber through the nozzle to the main liquid compartment. The nozzle may be in fluid connection with a transverse passage through the plug member, wherein the transverse passage is not in communication with the fluid chamber when the closure is in the closed position, and wherein the transverse passage is in communication with the fluid chamber when the closure is in the open position. Alternatively the plug member may be shaped such that in the open or firing position pressurised fluid can pass between the bottom aperture and the plug member.

Embodiment with Tank Above Neck

The threaded side wall of the cap member may extend below the bottom aperture of the fluid chamber. This has the result that in use, when the closure device is applied to a container by securing the threaded side wall of the cap member down onto the threaded container neck of the container, the fluid chamber extends at least partially above the container neck. In one embodiment the fluid chamber extends fully above the container neck.

The first detent member on the plug member housing may comprise one or more resilient flanges. The one or more resilient flanges may be arranged around the perimeter of the plug member housing. The plug member housing may include a location means provided at its lower side adapted to engage in the neck of a container. The location means may be a circular rib having an external diameter adapted to fit within the internal diameter of the neck of the container. The flange portion may extend beyond the location means, The second detent member on the cap member may comprise a rib provided on the inner surface of the threaded side wall of the cap member. The rib may be provided up the threaded portion of the threaded side wall.

Embodiment with Tank in Neck

The plug member housing may at least partially surround the fluid chamber.

The flange portion may be a flange member.

The first detent member may be a portion of the flange member and the second detent member may be a rib provided on an inner surface of the threaded side wall of the cap member.

The flange member may be adapted to be urged against the underside of the cap member by the container neck in the open position.

The flange member may be provided with first flange sealing means adapted to seal between the first detent member on the flange member and the second detent member on the cap member in the closed position.

The flange member may be provided with second flange sealing means adapted to seal against the underside of the cap member in the open position.

The first and second flange sealing means may be a coating of an elastic material, for example a thermoplastic elastomer (TPE).

The plug member housing may be provided with fluid chamber support means adapted to prevent the fluid chamber from moving relative to the housing from the closed position to the open position prior to placing the closure on a container.

The fluid chamber support means may comprise one or more collapsible support members extending from the plug member housing to the underside of the fluid chamber. The one or more collapsible support members may be arranged to contact the fluid chamber around the bottom aperture. The one or more collapsible support members may be adapted to collapse when the cap member is screwed down on the neck of the container to urge the flange upwards relative to the cap member and fluid chamber.

The flange member can be deformed by securing the closure device to a container neck, such that the top of the container neck is urged against the flange member.

The housing may include an upper cylindrical portion adapted to fit inside a neck of the container. The housing may include a plurality of leg members extending from the upper cylindrical portion to the plug member. The leg members may be spaced from each other to form a plurality of windows which allow fluid flow between the leg members. The leg members may be arranged to at least partially surround the fluid chamber so as to guide the fluid chamber while the fluid chamber moves from the closed position to the armed position and to the firing position.

ALL EMBODIMENTS

The plug member may be provided with a first plug sealing means adapted to seal against the bottom aperture in the closed position.

The plug member may be provided with a second plug sealing means adapted to seal between the bottom aperture and a portion of the plug member in the open position, to ensure that the only fluid communication path from the fluid chamber through or around the plug member in the open position is through the nozzle of the plug member.

The first and second plug sealing means may be a coating of an elastic material, for example a thermoplastic elastomer (TPE).

The fluid chamber may be bonded to the underside of the top wall of the cap member.

In the first closed position the closure device can be transported for subsequent fitting to a container. The first and second detent members serve to prevent the housing and plug member from moving under the internal pressure of the fluid chamber, thereby maintaining the fluid camber in a sealed, closed state.

When the closure device is fitted to a container, the container neck is urged against the flange member to raise the flange member, plug member housing and plug member relative to the fluid chamber, so that the closure device is in the second open position. The flange member itself may be held in a sealed manner against the top of the container neck, so that the container remains sealed closed while the bottom aperture is opened and liquid additive is fired from the fluid chamber into the container.

In the open position an additive liquid in the fluid chamber may be ejected through the nozzle under pressure.

Preferably the fluid chamber is pressurised. The additive liquid is then urged through the nozzle under pressure into the container where it is mixed with the liquid or beverage in the container as a result of being ejected through the nozzle under pressure.

The nozzle may be provided at the lower end of the plug member, opposite the fluid chamber. The plug member may include an internal nozzle passage extending axially upwards in the plug member from the nozzle.

The plug member may include a transverse internal passage extending to the lateral exterior surface of the plug member and in communication with the internal nozzle passage.

In the closed position the transverse internal passage may be closed by the bottom aperture of the fluid chamber. For example the first plug sealing means may seal between the plug member and the bottom aperture above the transverse internal passage.

In the firing position the first plug sealing means may no longer seal between the plug member and the bottom aperture, such that the fluid chamber is in fluid communication with the transverse internal passage and the nozzle. The second plug sealing means may seal between the plug member and the bottom aperture below the transverse internal passage.

Alternatively the plug member may include a longitudinal internal passage extending to the upper exterior surface of the plug member and in communication with the internal nozzle passage.

In the closed position the longitudinal internal passage may be closed by a projecting plug fixed relative to the fluid chamber.

In the firing position the projecting plug may be spaced from the upper exterior surface of the plug member, such that the fluid chamber is in fluid communication with the longitudinal internal passage and the nozzle.

The fluid chamber may be a single moulded article. The fluid chamber may be moulded from PET or other suitable plastic material.

Preferably the cap wall is provided with internal threads adapted to engage with external threads on the neck of the container.

The first detent member may engage with the second detent member to ensure that the plug member housing is removed with the rest of the closure device when the cap member is unscrewed from the container neck.

Container and Closure

According to a second aspect of the present invention there is provided a container having a container neck and an opening, wherein the container contains a liquid, and wherein a closure device according to the first aspect of the present invention is secured to the container neck to close the container.

Method of Firing

According to a third aspect of the present invention there is provided a method of introducing an additive liquid into a container, the method comprising:

providing a closure device according to the first aspect of the invention, introducing into the fluid chamber a liquid additive and a pressurised propellant, while the closure device is in the first closed position placing the closure device on the neck of a container containing a liquid, lowering the closure device onto the neck of the container such that the neck of the container contacts the flange member of the plug member housing, further lowering the closure device onto the neck of the container such that the neck of the container urges the flange member of the plug member housing towards the underside of the top wall of the cap member to a position in which the closure device is in a second open or firing position, such that the cap member and fluid chamber are lowered relative to the plug member, and such that a fluid communication path is provided from the fluid chamber through the nozzle of the plug member.

The lowering and/or further lowering of the closure device onto the neck of the container may be achieved by screwing the cap member onto threads provided on the neck of the container.

Preferably the method includes the step of urging the additive liquid from the fluid chamber into the container under pressure of the pressurised propellant in the fluid chamber while the closure device is in the second open or firing position.

Preferably the method includes the step of mixing the additive liquid with the liquid in the container.

The liquid in the container may be a beverage or a chemical or pharmaceutical composition. The liquid may be of any viscosity, for example a gel.

The mixing step may be effected through ejection of the additive liquid through the nozzle at a sufficient velocity under pressure of the pressurised propellant in the fluid chamber.

Preferably the method includes the further step of removing the closure device from the neck of the container to allow access to the mixed liquid. The removal may be achieved by raising the cap member on the neck of the container. The removal may be achieved by unscrewing the cap member from threads provided on the neck of the container.

BRIEF DESCRIPTION OF THE DRAWINGS

The invention will be described, by way of example only, with reference to the drawings in which.

DESCRIPTION OF SPECIFIC EMBODIMENTS

First Embodiment ("Tank in Neck")

Figure 1:
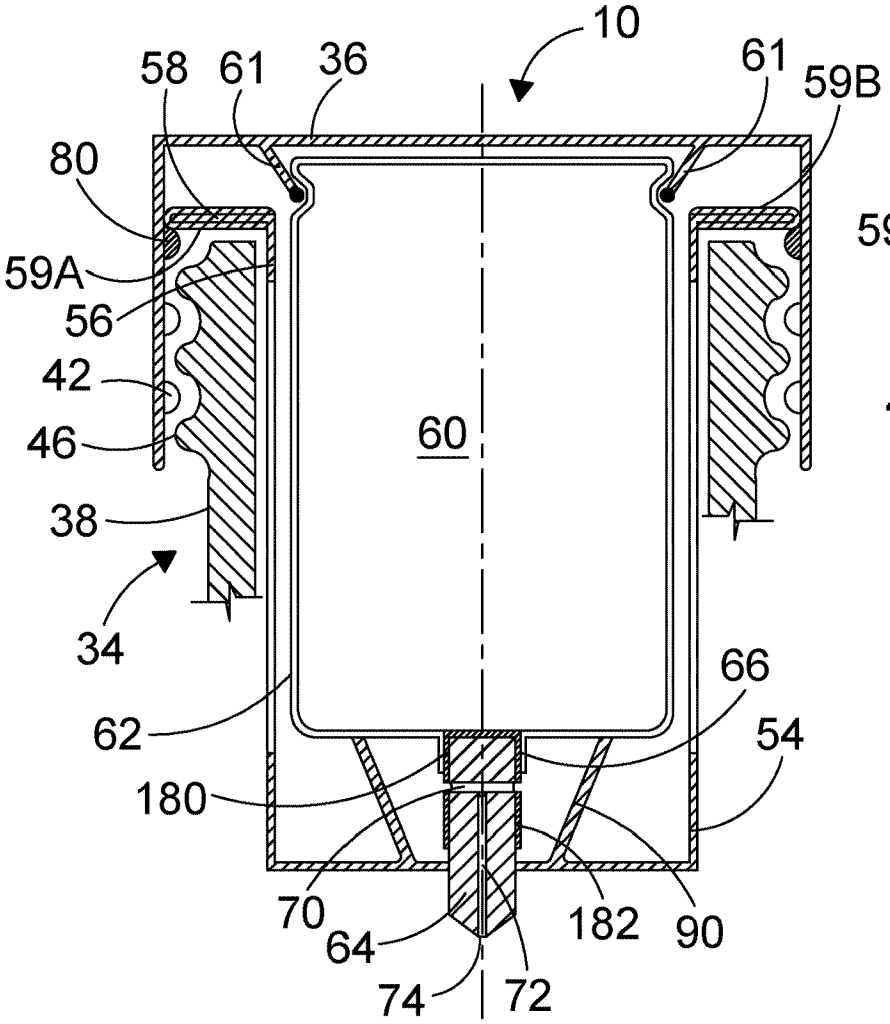
FIG. 1 shows a schematic cross-sectional view of a closure device according to an embodiment of the present invention in a first closed or armed position.

With reference to FIG. 1 there is shown a closure device 10 in a first closed position. The closure device 10 is depicted connected to the upper part of a container 34 that contains a fluid (not shown). The container depicted has a neck 38. The container 34 may be, for example, a PET bottle. The container 34 may hold a variety of liquids such as water, or a pharmaceutical or glucose solution. The liquid may be for consumption, but may instead be a chemical composition for other use, such as cleaning, healthcare, hair dye application, painting or household maintenance. However, for the purposes of this description, the liquid held in the container 34 will hereinafter be referred to as the beverage.

The closure device 10 includes a cap member 36. The closure device 10 is used to close an opening in the neck 38 and is attached to the container 34 by the cap member 36. The cap member 36 is detachably attached to the container neck 38 by a threaded arrangement. The threaded arrangement comprises an external thread 46 located on an outer surface of the container neck 38 that engages with an internal thread 42 located on an inner surface of the side wall of the cap member 36. Thus the cap member 36 can be unscrewed and removed by a user of the closure device 10. All of the aforementioned components may be formed of polypropylene, or other suitable material.

Although the invention is described with reference to a threaded arrangement, the threads may be omitted and the relative downward and upward movement of the cap member 36 on the container neck 38 may be achieved by simply pushing and pulling.

Inside the cap member 36 a fluid chamber 60 is located. The fluid chamber 60 contains an additive liquid and a pressured propellant fluid. The fluid held in the fluid chamber 60 may be of significantly greater pressure than the beverage held in the container 34. The fluid chamber 60 is enclosed by a fluid chamber wall 62. The fluid chamber 60 may be formed using plastic injection moulding and may be formed of PET or any other suitable plastic. In the example of FIG. 1 the fluid chamber 60 is formed as a separate blow moulded chamber and secured to the underside of the cap member 36 by push fit with a retaining member 61. However the fluid chamber 60 may be simply bonded to the underside of the cap member 36 by adhesive or formed by any other means.

The fluid chamber 60 is surrounded by a housing 54 that sits within the container neck 38. The housing 54 includes a cylindrical housing wall 56 that extends substantially parallel to the container neck 38. At the top of the housing wall 56 is a flange member 58 which extends over the top of the container neck 38 to engage with a detent 80 formed as a rib on the inside of the side wall of the cap member 36. The flange member 58 has a first seal 59A on its lower side which seals against the detent 80.

Figure 2:
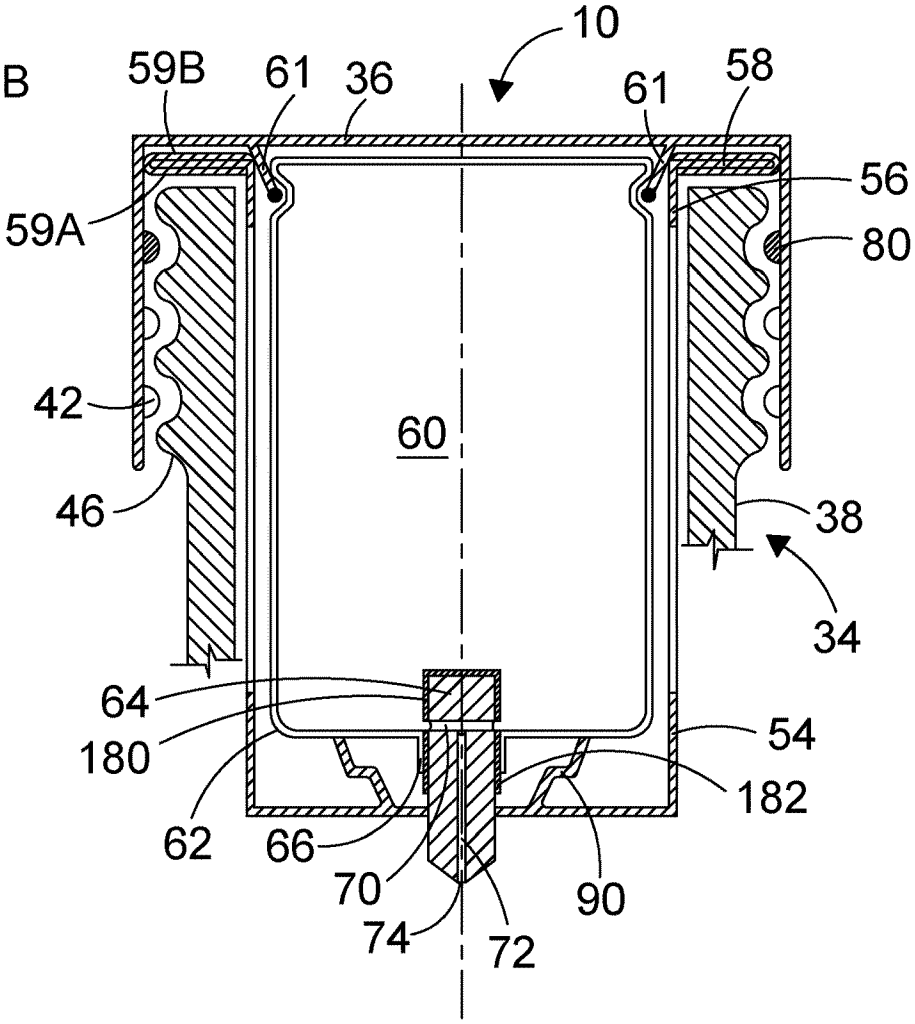
FIG. 2 shows a schematic cross-sectional view of the closure device of FIG. 1 in a second open or firing position.

When an upwards force is applied to the flange member 58, for example by the neck 38 when the cap member 36 is screwed down onto the neck 38, the flange member 58 is urged upwards relative to the cap member, until it reaches the position shown in FIG. 2, where the flange member 58 is in contact with the underside of the cap member 36. The flange member 58 has a second seal 59B on its upper side which seals against the cap member 36.

The housing 54 may further comprise leg members that extend from the cylindrical wall 56 to a plug member 64, defining windows therebetween. Alternatively the housing wall 56 may extend itself to the plug member 64.

Both the housing 54 and the plug member 64 may be formed by injection moulding or another suitable method. Typically the housing 54 fits in the neck 38, so that it can be inserted into or extracted from the neck without requiring a large force.

In then example of FIG. 1 the plug member 64 of the housing is a cylindrical member which extends upwards from the base of the housing 54 and is adapted to engage sealingly with an aperture 66 in the fluid chamber 60.

The plug member 64 includes a lateral passage 70 that extends between the outer walls of the plug member 64.

The plug member 64 further includes a longitudinal internal nozzle passage 72 that extends downwards from the lateral passage 70 to a nozzle 74. The plug member 64 has a coating of formed of a resilient, soft plastic or rubber material such as mouldable thermo plastic elastomer (TPE) or nitrile rubber, which acts to form first upper 180 and second lower 182 seals between the plug member 64 and the aperture 66 in the fluid chamber 60. Alternatively, separate O-ring seals could be utilised to form the seals between the plug member 64 and the aperture 66. The lower seal 182 may be omitted.

As an alternative, the plug member could be as illustrated in our co-pending International Patent Application No PCT/GB2017/051375. In this embodiment the plug member is a cylindrical member which extends upwards from the base of the housing and is adapted to engage sealingly with an aperture in the fluid chamber. The plug member has a central bore which is itself plugged by a spike plug member fixed by a number of radial arms to the top of the bottom aperture in the fluid chamber. The bore extends to an outlet nozzle at the lower end of the plug member.

The seals 59A, 59B on the flange 58 and the seals 180, 182 on the plug member 64 can be formed by over-moulding. PTE or similar material can be over-moulded to form all the seals in a single process, or they can be formed separately.

With reference to FIG. 1, the operation of the closure device is as follows. The closure device 10 can be assembled in a separate process and at a separate location from the filling process by which the container 34 is filled with a beverage. A liquid additive and a pressurised propellant are introduced into the fluid chamber 60 and the closure device is assembled to adopt the closed position illustrated in FIG. 1, for example by filing and assembling in a pressurised environment. In this position the internal pressure of the fluid chamber urges the plug member 64 out of the aperture 66, and so urges the housing 54 downwards relative to the fluid chamber 60 and cap member 36. However the engagement of the flange member 58 with the detent 80 prevents the separation of the housing 54 and cap member 36, and maintains the plug member 64 in the aperture 66. The flange member 58 in this embodiment is first detent member provided on the plug member housing 54, while the detent rib 80 is a second detent member provided on the cap member 36.

The closure device 10 may be transported to the container filling station in the closed position. For example, the closure device may be sold separately, and a consumer may apply the closure to a separate container containing a beverage without additive, for example water.

The housing 54 is provided with fluid chamber support means 90 which prevent the fluid chamber 60 from moving relative to the housing 54 from the closed position to the open position prior to placing the closure on a container, for example during transport. In the illustrated embodiment the fluid chamber support means 90 comprise a number of part-conical collapsible support members cantilevered from the housing 54, such that they contact the underside of the fluid chamber 60. The collapsible support members are arranged to contact the fluid chamber 60 around the bottom aperture 66. The support members 90 collapse when the cap member 36 is screwed down on the neck 38 of the container 34 to urge the flange 58 upwards relative to the cap member 36 and fluid chamber 60.

After the container 34 has been filled with a beverage, the closure device 10 is placed on the neck 38 of the container, still in the closed position. The closure device 10 is then lowered onto the neck of the container by screwing action until the top of the neck 38 of the container contacts the flange member 58 of the housing 54. Further lowering of the closure device 10, by further screwing action, onto the neck 38 of the container results in the neck 38 urging the flange member 58 towards the underside of the cap member 36.

The closure device 10 is screwed down as far as it can go, so the neck 38 presses the flange member 58 against the underside of the cap member 36, while the plug member 64 penetrates further into the aperture 66 in the fluid chamber 60, until the closure device 10 reaches the second open or firing position, illustrated in FIG. 2.

In the firing position a fluid communication path is provided from the fluid chamber 60 through the nozzle 74 of the plug member 64. In the firing position the plug member 64 extends into the aperture to a position in which the additive liquid is urged from the fluid chamber 60 through the lateral passage 70 that extends between the outer walls of the plug member 64, along the longitudinal internal nozzle passage 72 and out of the nozzle 74 into the main body of the container.

Second Embodiment ("Tank in Neck")

Figure 4:
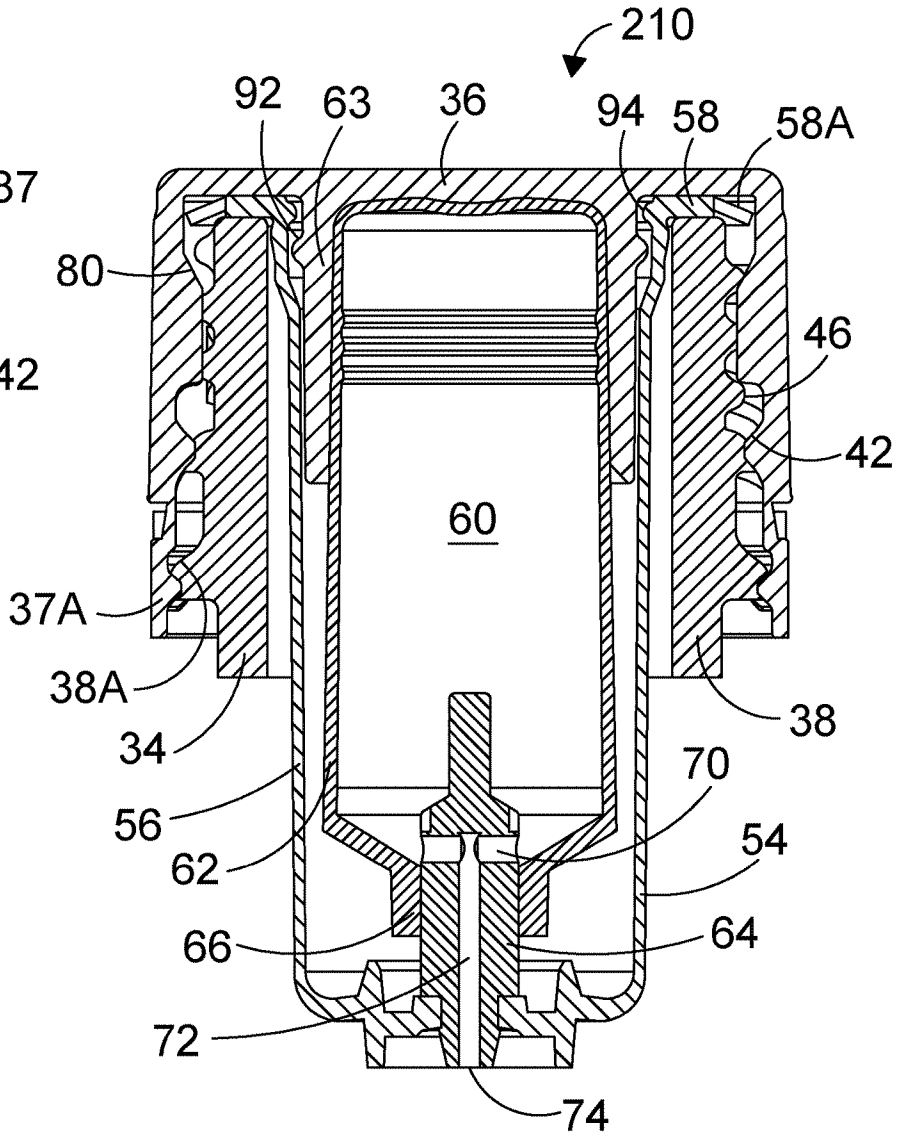
FIG. 4 shows a schematic cross-sectional view of the closure device of FIG. 3 in a second open or firing position.
Figure 3:
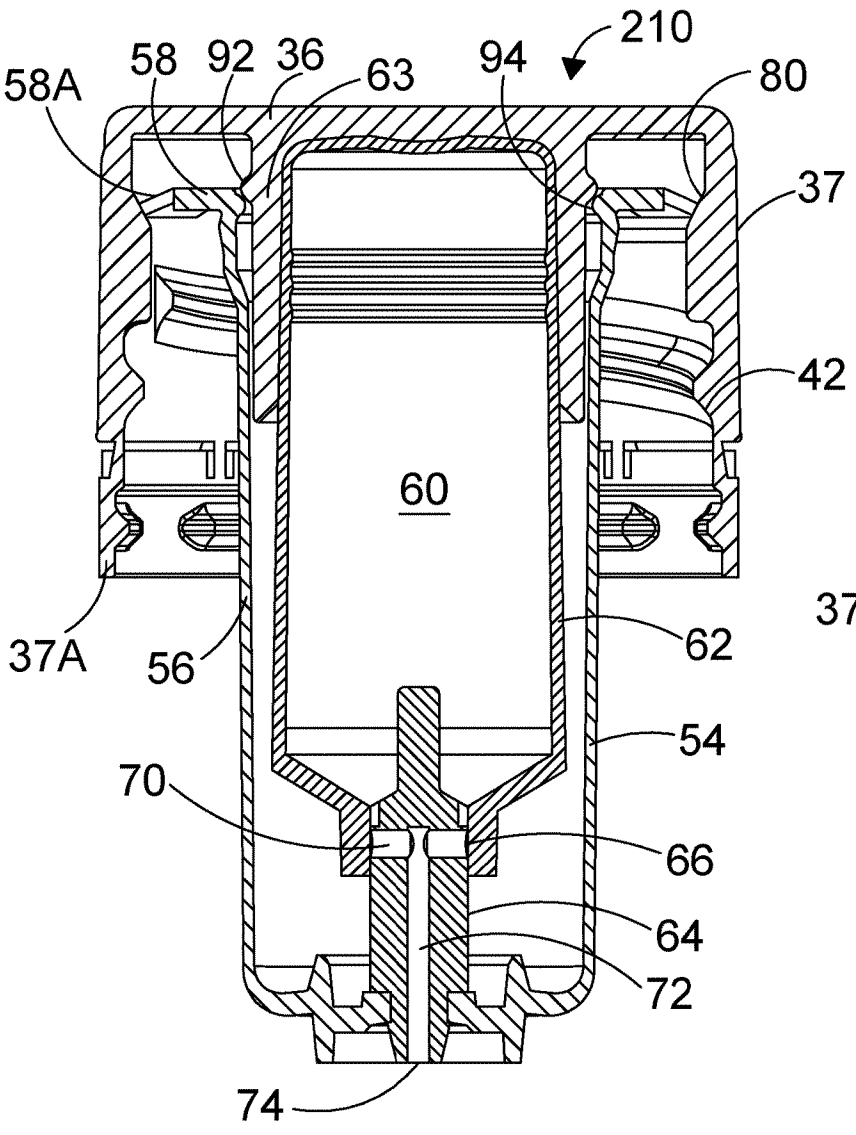
FIG. 3 shows a schematic cross-sectional view of a closure device according to another embodiment of the present invention in a first closed or armed position.
Figure 5:
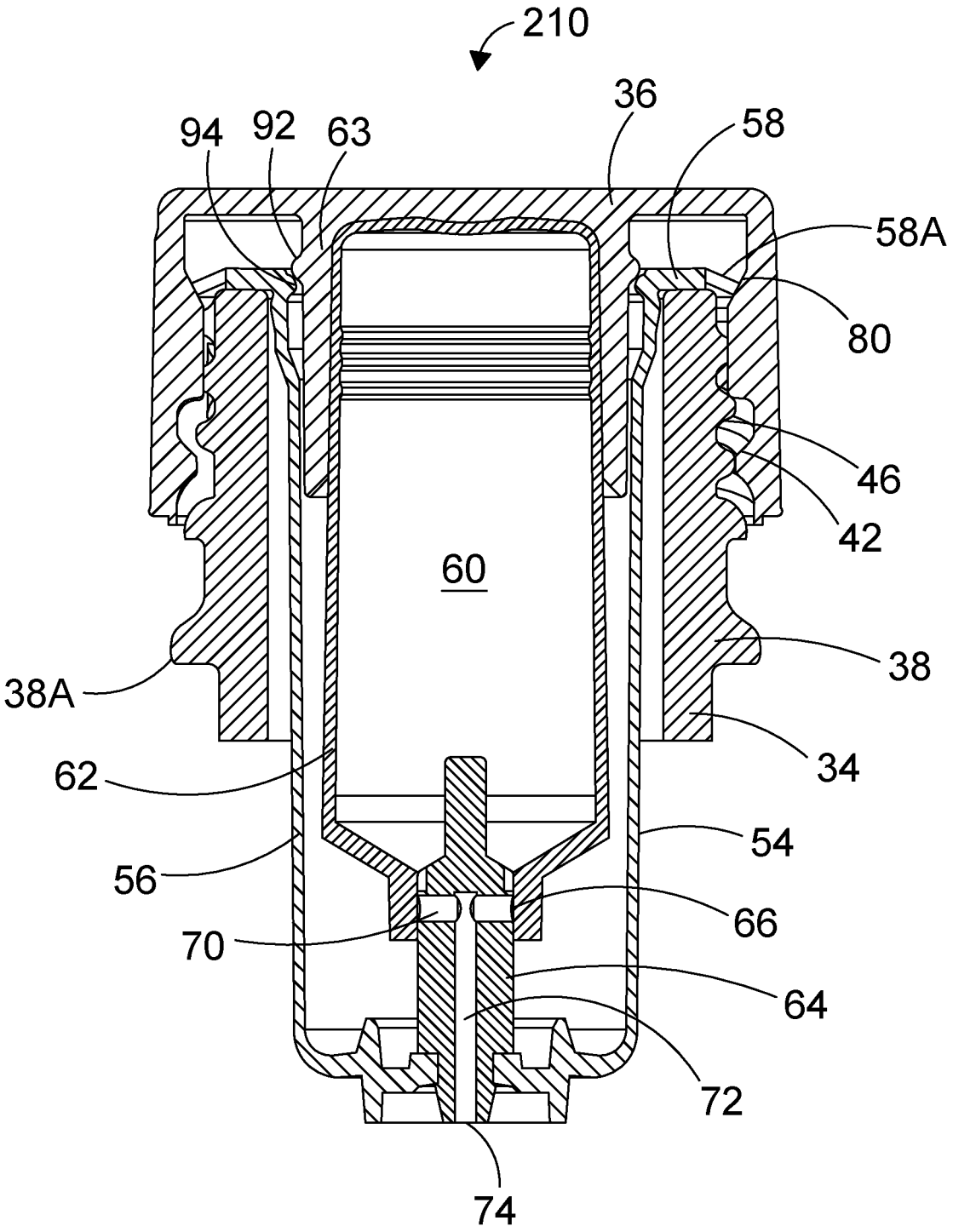
FIG. 5 shows a schematic cross-sectional view of the closure device of FIG. 3 in a third position during removal of the closure device from a neck of a container.

FIGS. 3, 4 and 5 show an embodiment of a closure device 210 of the invention which operates in a similar manner to the closure device 10 shown in FIGS. 1 and 2. Like components have the same reference numerals.

With reference to FIG. 3 the closure device 210 in a first closed position before screwing onto the neck 38 of a container 34, seen in FIGS. 4 and 5.

The closure device 20 includes a cap member 36 which ca securable to the container neck 38 by a threaded arrangement comprising an external thread 46 located on an outer surface of the container neck 38 that engages with an internal thread 42 located on an inner surface of the side wall 37 of the cap member 36. Inside the cap member 36 is a tank or fluid chamber 60, containing contains an additive liquid and a pressured propellant fluid. The fluid held in the fluid chamber 60 may be of significantly greater pressure than the beverage held in the container 34.

The fluid chamber 60 is enclosed by a fluid chamber wall 62. In the example of FIG. 3 the fluid chamber 60 is formed as a separate blow moulded chamber and secured to the underside of the cap member 36 by bonding or moulding the chamber 60 to a cylindrical sleeve 63 moulded integrally with the rest of the cap member 36.

The fluid chamber 60 is surrounded by a housing 54 that sits within the container neck 38, when the closure device is screwed to the neck 38, as shown in FIG. 4. The housing 54 includes a cylindrical housing wall 56 that extends substantially parallel to the container neck 38. At the top of the housing wall 56 is a flange member 58 which in the position shown in FIG. 4 seals against the top of the neck 38. The flange member 58 includes a number of flange retaining portions 58A arranged circumferentially around the perimeter of the flange 58. The retaining portions 58A of the flange 58 extend radially to engage with a detent 80 formed on the inside of the side wall 37 of the cap member 36.

The housing 54 includes a plug member 64 arranged at the lower end of the housing wall 56. Both the housing 54 and the plug member 64 may be formed by injection moulding or another suitable method. In the illustrated example the plug member 64 is formed separately and then snap-fitted to the housing 54, but they may be integrally formed. Typically the housing 54 fits in the neck 38, so that it can be inserted into or extracted from the neck without requiring a large force.

In the example of FIG. 3 the plug member 64 of the housing is a cylindrical member which extends upwards from the base of the housing 54 and is adapted to engage sealingly with an aperture 66 in the fluid chamber 60. The plug member 64 includes a lateral passage 70 that extends between the outer walls of the plug member 64.

The plug member 64 further includes a longitudinal internal nozzle passage 72 that extends downwards from the lateral passage 70 to a nozzle 74. The plug member 64 has an upper seal 180 formed of a resilient, soft plastic or rubber material such as mouldable thermo plastic elastomer (TPE) or nitrile rubber, which acts to seal between the plug member 64 and the aperture 66 in the fluid chamber 60. Alternatively, separate O-ring seals could be utilised to form the seals between the plug member 64 and the aperture 66.

The operation of the closure device is as follows. The closure device 210 can be assembled in a separate process and at a separate location from the filling process by which the container 34 is filled with a beverage. A liquid additive and a pressurised propellant are introduced into the fluid chamber 60 and the closure device is assembled to adopt the closed position illustrated in FIG. 3, for example by filing and assembling in a pressurised environment. In this position the internal pressure of the fluid chamber urges the plug member 64 out of the aperture 66, and so urges the housing 54 downwards relative to the fluid chamber 60 and cap member 36. However the engagement of the retaining portions 58A of the flange 58 with the detent 80 prevent the separation of the housing 54 and cap member 36, and maintain the plug member 64 in the aperture 66. The retaining portions 58A of the flange 58 in this embodiment form a first detent member provided on the plug member housing 54, while the detent rib 80 is a second detent member provided on the cap member 36.

The closure device 10 may be transported to the container filling station in the closed position. For example, the closure device may be sold separately, and a consumer may apply the closure to a separate container containing a beverage without additive, for example water.

After the container 34 has been filled with a beverage, the closure device 210 is placed on the neck 38 of the container, still in the closed position. The closure device 210 is then lowered onto the neck of the container by screwing action until the top of the neck 38 of the container contacts the flange member 58 of the housing 54. A resistance to further twisting is provided by the engagement of an external circumferential rib 92 provided on the cylindrical sleeve 63 of the cap member 36 with an internal circumferential rib 94 provided on the flange 58 of the housing 54.

The circumferential ribs 92, 94 together form a fluid chamber support means adapted to prevent the fluid chamber 60 from moving relative to the plug member housing 54 from the closed position to the open position prior to placing the closure 210 on a container. In addition the internal pressure in the fluid chamber 60 acts to urge the plug member 64 out of the fluid chamber aperture 66, and so also acts to prevent the fluid chamber 60 from moving relative to the plug member housing 54 from the closed position to the open position, since in the open position the plug member 64 must move into, not out of, the fluid chamber aperture 66.

Further lowering of the closure device 10, by further screwing action with sufficient force, overcomes the detent action of the ribs 92, 94, so that the neck 38 urges the flange member 58 towards the underside of the cap member 36, to adopt the position shown in FIG. 4. The closure device 10 is screwed down as far as it can go, so the neck 38 presses the flange member 58 against the underside of the cap member 36, while the plug member 64 penetrates further into the aperture 66 in the fluid chamber 60, until the closure device 10 reaches the second open or firing position, illustrated in FIG. 4.

In the firing position a fluid communication path is provided from the fluid chamber 60 through the nozzle 74 of the plug member 64. In the firing position the plug member 64 extends into the aperture 66 to a position in which the additive liquid is urged from the fluid chamber 60 through the lateral passage 70 that extends between the outer walls of the plug member 64, along the longitudinal internal nozzle passage 72 and out of the nozzle 74 into the main body of the container 34.

Once the additive liquid has been fired into the container 34, the closure device 210 can be removed by unscrewing from the neck 38 of the container 34. If required, an anti-tamper band 37A may be provided at the lower end of the outer wall 37 of the cap member 36. When the cap member 36 is screwed onto the neck, the anti-tamper band 37A engages with a one way detent member 38A provided on the neck 38, so that the cap member cannot be removed from the neck 34 without shearing the anti-tamper band 37A from the outer wall 37. Initially the housing 54 remains in the neck 38, while the cap member 36 is raised on the threads 42, 46, so that the plug member 64 again seals the aperture 66 in the tank 60 closed. The flange 58 then engages with the detent 80, as shown in FIG. 5, and further rotation of the cap member 36 causes the housing 54 to be lifted with the cap member 36, so that the whole closure device 210 can be removed from the neck 38.

Third Embodiment ("Tank Above Neck")

Figure 7:
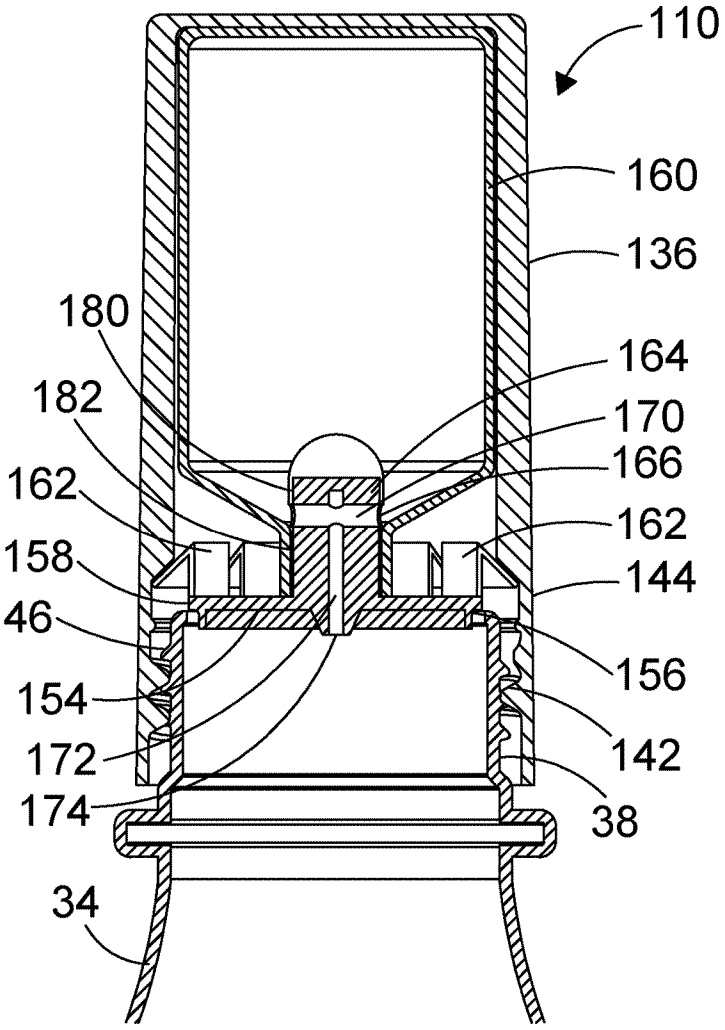
FIG. 7 shows a schematic cross-sectional view of the closure device of FIG. 6 in a second open or firing position.
Figure 6:
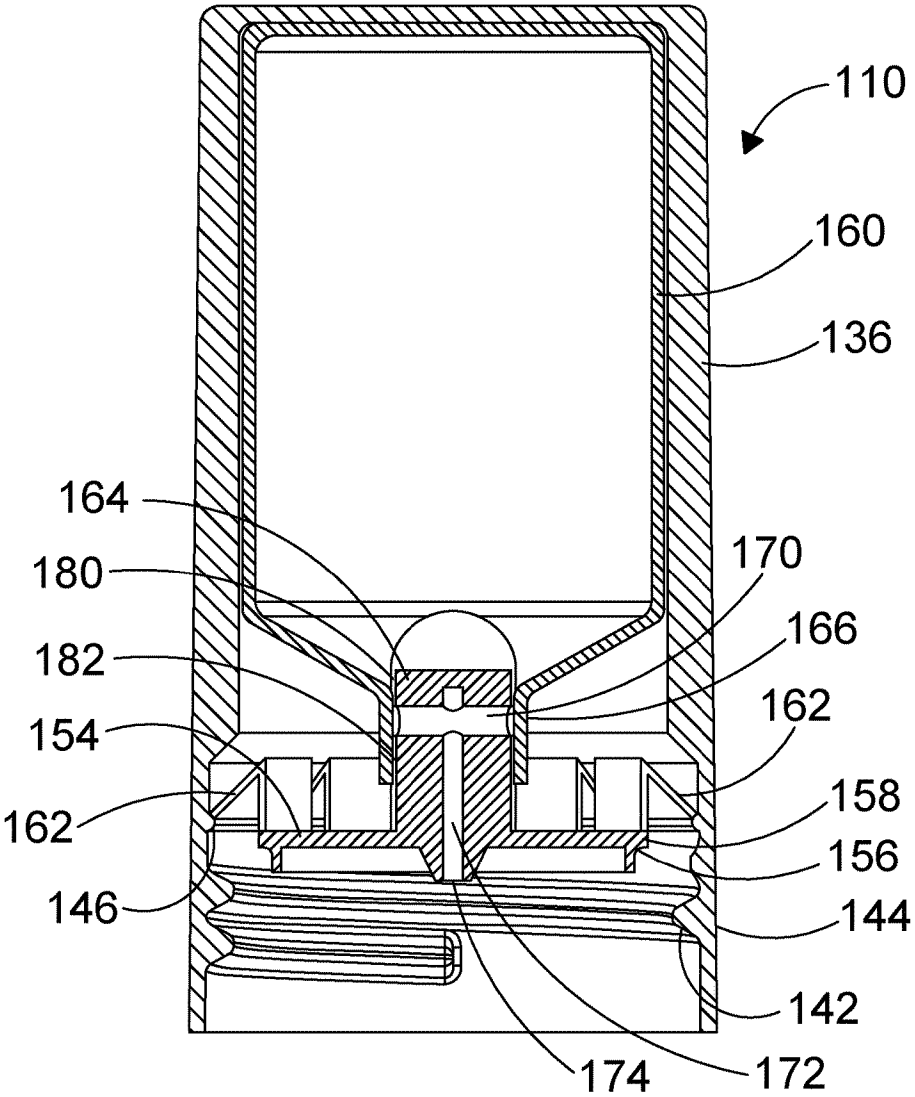
FIG. 6 shows a schematic cross-sectional view of a closure device according to another embodiment of the present invention in a first closed or armed position.

FIGS. 6 and 7 show an embodiment of a closure device 110 of the invention which is particularly suited for supply as a separate closure containing an additive liquid which may be added by an end user to a bottle or container containing another liquid such as water.

The closure device 110 is shown in its closed position in FIG. 6, in the state in which it might be supplied to an end user, optionally in protective packaging such as a bag or sachet. In use, as shown in FIG. 7, the closure device 110 is screwed onto a container 34 that contains a fluid (not shown). The container depicted has a neck 38. The container 34 may be, for example, a PET bottle. The container 34 may hold a variety of liquids such as water, or a pharmaceutical or glucose solution. The liquid may be for consumption, but may instead be a chemical composition for other use, such as cleaning, healthcare, hair dye application, painting or household maintenance. However, for the purposes of this description, the liquid held in the container 34 will hereinafter be referred to as the beverage.

The closure device 110 includes a cap member 136 within which is secured a fluid chamber 160. The cap member 136 has an internal thread 142 located on an inner surface of a side wall 144 which extends below the fluid chamber 160. The internal thread 142 is adapted to engage with an external thread 46 on the neck 38 of the container 34. A detent means in the form of a circumferential rib 146 is provided on the inner surface of the side wall 144 above the internal thread 142.

Although the invention is described with reference to a threaded arrangement, the threads may be omitted and the relative downward and upward movement of the cap member 136 on the container neck 38 may be achieved by simply pushing and pulling.

The fluid chamber 160 contains an additive liquid and a pressured propellant fluid. The fluid chamber 160 may be formed using plastic injection moulding and may be formed of PET or any other suitable plastic. In the example of FIG. 6 the fluid chamber 160 is formed as a separate blow moulded chamber and secured to the inside of the cap member 136 by bonding or any suitable means.

Beneath the fluid chamber 160 is a plug member housing 154 which houses or supports a plug member 164. The plug member housing 154 includes a flange portion 158 which in use extends over the top of the container neck 38, as shown in FIG. 7. The flange portion 158 may include a seal (not shown) which serves to seal between the flange portion 158 and the top of the neck 38 of the bottle. The plug member housing 154 includes a circular rib 156 on its lower surface which is adapted to fit inside the container neck 38 to aid location of the housing 154 within the neck 38. The housing 154 also includes a plurality of resilient detent flanges 162 provided around the perimeter of the housing 154. These resilient detent flanges 162 have a "barb" shape so that they can pass upwards over the circumferential rib 146 on the inner surface of the side wall 144 of the cap member 136, but cannot readily pass back downwards past the circumferential rib 146.

Both the housing 154 and the plug member 164 may be formed by injection moulding or another suitable method.

In the example of FIG. 6 the plug member 164 is a cylindrical member which extends upwards from the housing 154 and is adapted to engage sealingly with an aperture 166 in the fluid chamber 160.

The plug member 164 includes a lateral passage 170 that extends between the outer walls of the plug member 164, and a longitudinal internal nozzle passage 172 that extends downwards from the lateral passage 170 to a nozzle 174 formed below the plug member housing 154. The plug member 164 has a coating formed of a resilient, soft plastic or rubber material such as mouldable thermo plastic elastomer (TPE) or nitrile rubber, which acts to form first upper 180 and second lower 182 seals between the plug member 164 and the aperture 166 in the fluid chamber 160. Alternatively, separate O-ring seals could be utilised to form the seals between the plug member 164 and the aperture 166. The lower seal 182 may be omitted.

As an alternative, the plug member could be as illustrated in our co-pending International Patent Application No PCT/GB2017/051375. In this embodiment the plug member is a cylindrical member which extends upwards from the plug member housing 154 and is adapted to engage sealingly with an aperture in the fluid chamber. The plug member has a central bore which is itself plugged by a spike plug member fixed by a number of radial arms to the top of the bottom aperture in the fluid chamber. The bore extends to an outlet nozzle at the lower end of the plug member.

With reference to FIGS. 6 and 7, the operation of the closure device 110 is as follows. The closure device 110 can be assembled and filled in a separate process. A liquid additive and a pressurised propellant are introduced into the fluid chamber 160 and the closure device is assembled to adopt the closed position illustrated in FIG. 6, for example by filing and assembling in a pressurised environment. In this position the internal pressure of the fluid chamber 160 urges the plug member 164 out of the aperture 166, and so urges the housing 154 downwards relative to the fluid chamber 160 and cap member 136. However the engagement of the resilient flanges 162 with the detent rib 146 prevents the separation of the housing 154 and cap member 136, and maintains the plug member 164 in the aperture 166. The resilient flanges 162 in this embodiment form a first detent member provided on the plug member housing 154, while the detent rib 146 is a second detent member provided on the cap member 136.

The closure device 110 may be transported and supplied to an end user in the closed position shown in FIG. 6. For example, the closure device 110 may be sold separately, and a consumer may apply the closure device to a separate container containing a beverage without additive, for example still water or sparking water. The pressure in the fluid chamber 160 acting on the plug member 164 is sufficient to prevent the fluid chamber 160 from moving from the closed position to the open position prior to placing the closure on a container, for example during transport.

The housing 154 is protected by being enclosed within the side wall 144 of the cap member 136. The threaded side wall 144 of the cap member 136 extends below the bottom aperture 166 of the fluid chamber 160, and below the nozzle 174 in the plug member 164. Accordingly it is more difficult to inadvertently move the housing 154 upwards relative to the cap member 136 to accidentally fire the closure device 110. Hence in the illustrated embodiment no separate fluid chamber support means is provided. However, if required, a separate fluid chamber support means may be provided. For example mutually engaging detent ribs similar to the detent ribs 92, 94 in FIGS. 3 to 5 may be provided on the internal surface of the wall of the fluid chamber aperture 166 and on the external surface of the plug member 164. Alternatively collapsible support members may be provided on the housing 154 to engage with the underside of the fluid chamber 160, similar to the fluid chamber support means 90 in FIGS. 1 and 2.

After the container 34 has been filled with a beverage, the closure device 110 is placed on the neck 38 of the container, still in the closed position. The closure device 110 is then lowered onto the neck 38 of the container by screwing action until the top of the neck 38 of the container contacts the flange portion 158 of the housing 154. Further lowering of the closure device 110, by further screwing action, onto the neck 38 of the container results in the neck 38 urging the flange portion 158 and the housing 154 upwards relative to the cap member 136 toward the fluid chamber 160.

The closure device 110 is screwed down as far as it can go, until the housing 154 contacts the fluid chamber 160, in the second open or firing position, illustrated in FIG. 7. The flange portion 158 of the housing 154 remains in contact with, and seals against, the top of the neck 34.

In the firing position a fluid communication path is provided from the fluid chamber 160 through the nozzle 174 of the plug member 164. In the firing position the plug member 164 extends into the aperture to a position in which the additive liquid is urged from the fluid chamber 160 through the lateral passage 170 that extends between the outer walls of the plug member 164, along the longitudinal internal nozzle passage 172 and out of the nozzle 174 into the main body of the container. Because the fluid chamber 160 is pressurised, the additive exits the nozzle 174 at high speed, and is effectively mixed with the fluid in the container.

Because the closure device of the present invention does not require a housing flange between the external thread of the bottle neck and the internal thread of an outer cap wall, the closure device of the present invention can be no wider than a conventional closure. However the fluid chamber can have a relatively large volume, because it does not have to be accommodated in the neck of the bottle. This makes the invention suitable for delivering and mixing a large volume of additive to a bottle.

Although in the illustrated embodiment of FIGS. 6 and 7 the fluid chamber 160 is shown as extending fully above the threaded side wall; 144, such that in use the fluid chamber 160 is located fully above the neck 38 of the container 34, the shape of the plug member housing 154 can be modified such that the plug member 164 sits partially or fully within the neck 38 when the closure device is attached to a container 34, and the fluid chamber also extends partially into the neck 38.

The closure device of the present invention has only one threaded connection so the problem with prior art closures, that the two threaded connections may not turn in the correct order, is eliminated.

The closure device of the present invention may be provided separately from the container and may be fired to introduce the additive simply by screwing the closure device down onto the threaded neck of the container.

The invention is not limited to the specific embodiments described, and modifications and alternatives are possible. The shape, material and size of the various components can be modified. In particular the shape and size of the flange portion can be varied, as can the nature of the deformation of the flange portion.

The closure device of the present invention has a small number of parts. The housing and the tank or fluid chamber can be moulded separately. The seals, which are only required on the housing and plug member, which are part of the same moulded component, can be readily formed readily by over moulding, resulting in a low cost, easy to manufacture closure.

The invention claimed is:

1. A closure device for dispensing an additive product into a container having a main liquid compartment and an opening with a threaded container neck, the closure device comprising:

a cap member having a threaded side wall adapted to be secured to the threaded container neck, a pressurised fluid chamber containing an additive product, the fluid chamber being fixed to the cap member and having a bottom aperture at its lower end, a plug member housing including a plug member and a flange portion adapted to extend at least partially across the top of the container neck, the plug member being sealingly engageable in the bottom aperture of the fluid chamber, wherein the plug member is provided with a nozzle, wherein the plug member housing is adapted to move relative to the cap member between a first closed position of the closure device, in which the plug member seals the bottom aperture closed and in which a first detent member provided on the plug member housing is engaged by a second detent member provided on the cap member to prevent movement of the plug member housing away from the cap member, and a second open or firing position, in which the plug member housing is urged towards the cap member by contact with the threaded container neck and the plug member is raised relative to the bottom aperture to provide a fluid path for the additive product from the fluid chamber through the nozzle to the main liquid compartment.

2. The closure device of claim 1, wherein the fluid chamber contains a pressurised additive liquid and a propellant fluid.

3. The closure device of claim 1 or 2, wherein the threaded side wall of the cap member extends below the bottom aperture of the fluid chamber.

4. The closure device of claim 1, wherein the first detent member on the plug member housing comprises one or more resilient flanges arranged around the perimeter of the plug member housing.

5. The closure device of claim 4, wherein the second detent member on the cap member comprises a rib provided on the inner surface of the threaded side wall of the cap member.

6. The closure device of claim 1, wherein the plug member housing at least partially surrounds the fluid chamber.

7. The closure device of claim 1, wherein the flange member is adapted to be urged against the underside of the cap member by the container neck in the open position.

8. The closure device of claim 7, wherein the flange member is provided with a first flange sealing means adapted to seal between the first detent member on the flange member and the second detent member on the cap member in the closed position.

9. The closure device of claim 8, wherein the flange member is provided with a second flange sealing means adapted to seal against the underside of the cap member in the open position.

10. The closure device of claim 1, wherein the plug member housing is provided with fluid chamber support means adapted to prevent the fluid chamber from moving relative to the housing from the closed position to the open position prior to placing the closure on a container.

11. The closure device of claim 1, wherein the housing includes an upper cylindrical portion adapted to fit inside a neck of the container.

12. The closure device of claim 1, wherein the plug member is provided with a first plug sealing means adapted to seal against the bottom aperture in the closed position.

13. A container having a container neck and an opening, wherein the container contains a liquid, and wherein a closure device according to claim 1 is secured to the container neck to close the container.

14. A method of introducing an additive liquid into a container, the method comprising:

providing a closure device according to claim 1, introducing into the fluid chamber a liquid additive and a pressurised propellant, while the closure device is in the first closed position placing the closure device on the neck of a container containing a liquid, lowering the closure device onto the neck of the container such that the neck of the container contacts the flange member of the plug member housing, and further lowering the closure device onto the neck of the container such that the neck of the container urges the flange member of the plug member housing towards the underside of the top wall of the cap member to a position in which the closure device is in a second open or firing position, such that the cap member and fluid chamber are lowered relative to the plug member, and such that a fluid communication path is provided from the fluid chamber through the nozzle of the plug member.

15. The method of claim 14, wherein the further lowering of the closure device onto the neck of the container is achieved by screwing the cap member onto threads provided on the neck of the container.

16. The method of claim 14, wherein the method includes the step of urging the additive liquid from the fluid chamber into the container under pressure of the pressurised propellant in the fluid chamber while the closure device is in the second open or firing position.

17. The method of claim 16, wherein the method includes the further step of removing the closure device from the neck of the container to allow access to the mixed liquid by raising the cap member on the neck of the container.

18. The method of claim 17, wherein the removal of the closure device from the neck of the container is achieved by unscrewing the cap member from threads provided on the neck of the container.

* * * * *